US005418521A

United States Patent [19]

Read

[11] Patent Number: 5,418,521

[45] Date of Patent: May 23, 1995

[54] POWER CABLE WITH ALARM

[76] Inventor: Robert Read, 125 Euclid Ave., Massapequa, N.Y. 11758

[21] Appl. No.: 157,961

[22] Filed: Nov. 24, 1993

[51] Int. Cl.[6] ..... G08B 13/14

[52] U.S. Cl. ..... 340/568; 200/61.59; 340/540; 340/687

[58] Field of Search ..... 340/568, 687, 540; 200/61.59

[56] References Cited

U.S. PATENT DOCUMENTS

| | | | |
|---|---|---|---|
| 2,306,206 | 12/1942 | Dalgleish | 439/357 |
| 2,799,852 | 7/1957 | Barnes | 340/568 |
| 3,090,948 | 5/1963 | Cremer | 340/568 |
| 3,781,857 | 12/1973 | Stendig et al. | 340/521 |
| 4,009,474 | 2/1977 | Eller | 340/568 |
| 4,097,843 | 6/1978 | Basile | 340/687 |
| 4,118,690 | 10/1978 | Paynton | 340/687 |
| 4,121,201 | 10/1978 | Weathers | 340/524 |
| 4,189,723 | 2/1980 | Hylton | 340/568 |
| 4,390,868 | 6/1983 | Garwin | 340/568 |
| 4,584,570 | 4/1986 | Dotson | 340/568 |
| 4,855,719 | 8/1989 | Posey | 340/568 |
| 5,034,723 | 7/1991 | Maman | 340/568 |
| 5,089,807 | 2/1992 | Shim | 340/568 |

*Primary Examiner*—Glen Swann
*Attorney, Agent, or Firm*—Dilworth & Barrese

[57] ABSTRACT

The power cable includes an elongated cable having a plurality of conductors extending therewithin and first and second connectors positioned at respective ends of the elongated cable. Each connector includes a plurality of contacts which are connected to corresponding conductors within the cable. An alarm member is integrally associated with the cable and includes an audible alarm which is responsive to an alarm switch positioned within either the first or the second connector. A battery powered alarm system may also be provided to actuate when the cable is disconnected from the a.c. outlet.

19 Claims, 4 Drawing Sheets

POWER CABLE WITH ALARM

BACKGROUND OF THE INVENTION

1. Field of the Invention

The present invention relates to portable electric power cables having a built in alarm to detect removal of electrical equipment from the cable. More particularly, the present invention relates to extension cords having an alarm built therein which actuates when electrical equipment is disconnected from the extension cord.

2. Description of the Related Art

Today burglary is a common occurrence in the home as well as the workplace. With this in mind, there are many instances when it is desirable to provide security systems for electrical equipment or appliances maintained and used in the home or workplace. For example, on construction sites the various craftsmen use electrical equipment, such as saws, compressors and the like, which are remote from the actual working location and connected to a power source by an extension cord. In such instances, the electrical equipment is left unattended for periods of time, leaving the equipment accessible to a thief. As another example, during holiday seasons it is common for homeowners to place decorative lighting around the exterior of the house or in trees around the home. Thus, when the homeowner is not home or during the late evening or early morning hours, this decorative lighting is left unattended and easily accessible to a thief.

Numerous types of security systems for electrical equipment have been found in the art. For example, U.S. Pat. Nos. 2,799,852, 3,090,948, 3,781,857, 4,189,723 and 4,855,719 generally relate to electrical receptacles having an alarm or being connected to a remote alarm which is responsive to the insertion or removal of a plug in the receptacle. However, these types of receptacle alarm systems are interrelated with fixed electrical wall receptacles which are permanently installed in either the workplace or the home.

Therefore, a need exists for an electrical power cable assembly which is portable, cost effective and which has an alarm which is remote from the location where the electrical equipment is connected thereto.

SUMMARY OF THE INVENTION

The present invention provides a power cable which supplies power to electrical equipment and which detects removal of the electrical equipment therefrom. The power cable includes an elongated cable having a plurality of conductors extending therethrough, and first and second connectors connected to respective ends of the elongated cable. The first connector has a plurality of contacts for connection to a source of electrical power and the second connector has a plurality of contacts for connection to the electrical equipment. Preferably, the first connector is a male connector and the second connector is a female connector. The power cable also includes an alarm member which is integrally associated with the elongated cable and which is responsive to means positioned within the second connector and operatively connected to the alarm member for actuating the alarm member upon disengagement of the connector from either connection, e.g., the connection to the power source or the connection to the electrical equipment.

In the preferred embodiment, the alarm member comprises a housing positioned along at least a portion of the elongated cable and an audible alarm, such as a electro-acoustic transducer, positioned at least partially within the housing and connected to at least one of the plurality of conductors. The actuating means comprises a normally closed switch associated with at least one of the plurality of contacts of the second connector. Thus, when a plug assembly of electrical equipment is connected to the second connector, the actuating means is in a non-actuating position, i.e., the switch is open. When the plug is disconnected from the second connector, the actuating means returns to its normally closed position and actuates the alarm member.

In an alternative embodiment, the present invention provides a power cable which supplies power to electrical equipment and which detects removal of the electrical equipment therefrom. In this alternative embodiment, the power cable includes an elongated cable having a plurality of conductors extending therethrough and first and second connectors connected to respective ends of the elongated cable. The first connector has a plurality of contacts for connection to a source of electrical power and the second connector has a plurality of contacts for connection to the electrical equipment. The power cable also includes an alarm member which is operatively associated with the elongated cable and which is responsive to means positioned within the second connector and operatively connected to the alarm member for actuating the alarm member. Switch means positioned at least partially within the alarm member is operatively connected thereto and is operatively connected to at least one of the plurality of conductors. The switch means is provided to selectively supply the source of power to the second connector without interrupting the operation of the alarm member.

In another alternative embodiment, the power cable of the present invention includes a battery powered alarm system which actuates when the cable is removed from an a.c. power source. In this embodiment, the power cable comprises an elongated cable having a plurality of conductors extending therethrough and having first and second connectors connected to respective ends of the cable. Preferably, the first and second connectors have a plurality of contacts for connection to a source of electrical power or to the electrical equipment. Alarm means is provided and is integrally associated with the elongated cable. The alarm means is responsive to removal of either connector from either connection, such that an alarm is generated upon removal of either connector or both from one of the connections. Actuating means is positioned within at least one of the connectors and is operatively connected to the alarm means for actuating the alarm means. Preferably, the alarm means is positioned within an alarm housing integrally associated with said elongated cable.

The power cable of this alternative embodiment also includes a first switch member positioned at least partially within said housing and operatively connected to at least one of the plurality of conductors for selectively supplying a source of power to said second connector. A second switch member is also provided and positioned at least partially within said housing and operatively connected to at least one of the plurality of conductors for selectively supplying a source of power to said first connector.

BRIEF DESCRIPTION OF THE DRAWINGS

Preferred embodiments of the invention are described hereinbelow with reference to the drawings wherein.

DETAILED DESCRIPTION OF THE PREFERRED EMBODIMENTS

Generally, the power cable of the present invention is configured to supply power to various types of electrical equipment or other assemblies which utilize electrical power and which are used in locations remote from a permanent source of electric power. In addition, the power cable of the present invention may be configured for indoor and/or outdoor use.

Figure 1:
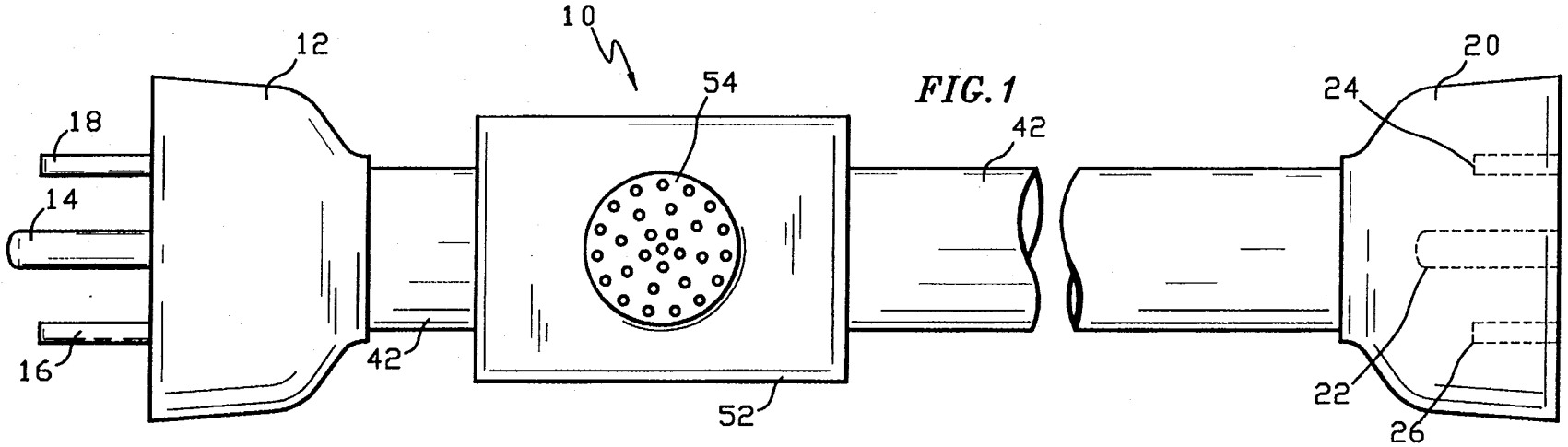
FIG. 1 illustrates the electrical power cable of the present invention having a male connector, a female connector and an alarm system.
Figure 2:
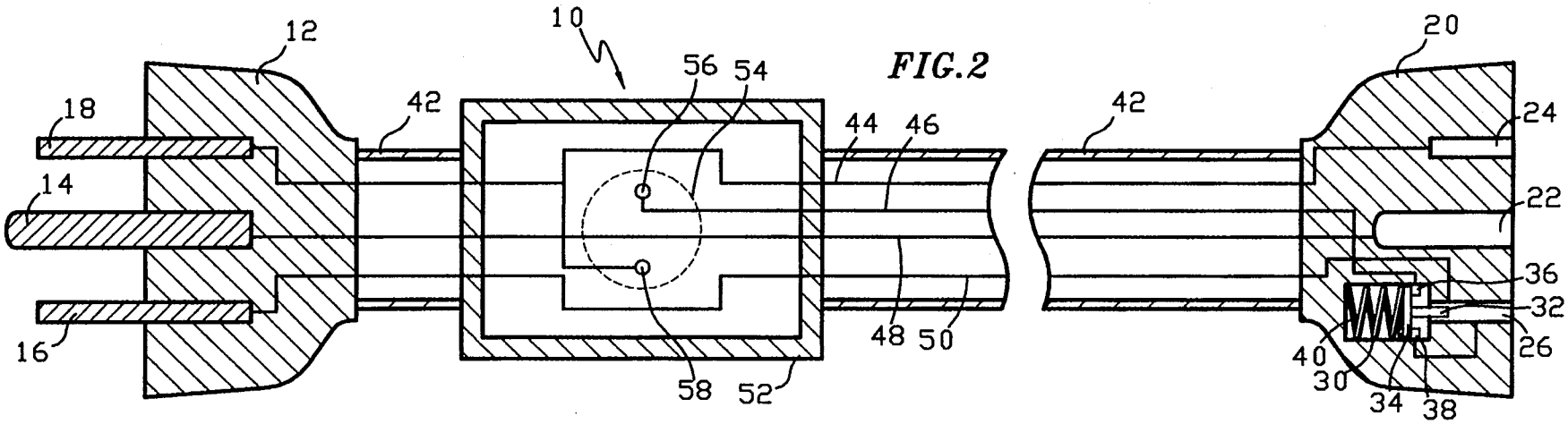
FIG. 2 is a cross-sectional view of the power cable of FIG. 1, illustrating exemplary electrical connections between the alarm system and the male and female connectors.

Referring to FIGS. 1 and 2, the power cable 10 of the present invention is configured to connect to standard three prong grounded receptacles. Power cable 10 includes male connector 12 having grounding contact 14 and a pair of current contacts 16 and 18. Preferably, male connector 12 is configured to connect to a permanent source of power (e.g., 110$^{v}$ or 220$^{v}$) or to connect to another power cable. Female connector 20 has a grounding slot 22 and a pair or current slots 24 and 26 which are configured to connect to electrical equipment or appliances. Examples of the types of electrical equipment which may be connected to female connector 20 include compressors, saws, radios, televisions, lighting and the like.

Figure 3:
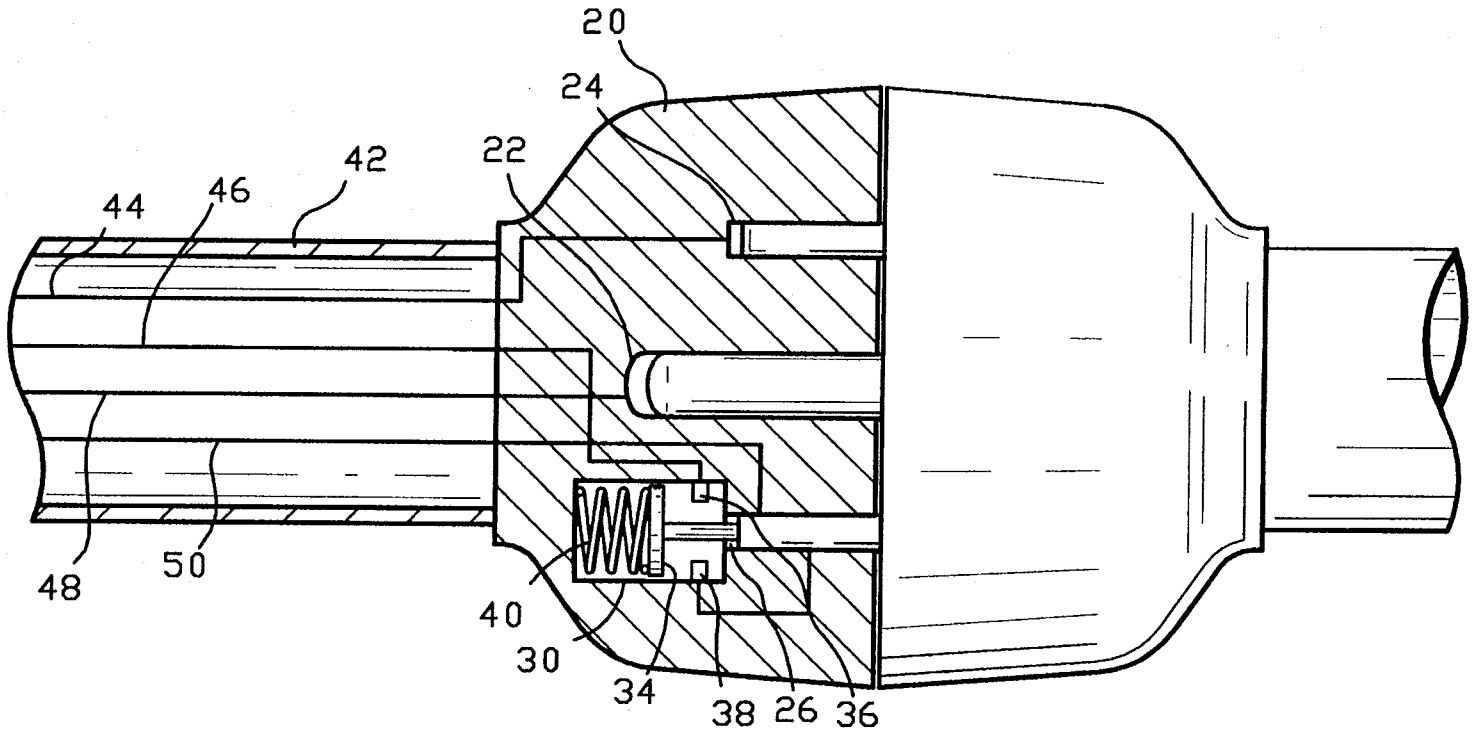
FIG. 3 is a partial cross-sectional view of the female connector of FIG. 2 interconnected with a male connector of an electrical appliance and illustrating an alarm switch in a non-actuated position.

Alarm switch 30, preferably a normally closed push-button type switch, is positioned within female connector 20 adjacent to current slot 26 so that actuating arm 32 of alarm switch 30 is positioned within slot 26, as shown in FIG. 2. Contact plate 34 is connected to one end of actuating arm 32 and provides a conductive medium between switch contacts 36 and 38. Preferably, actuating arm 32 is fabricated from a dielectric material, such as plastic. Contact plate 34 is movable between an actuating position, shown in FIG. 2, and a non-actuating position, shown in FIG. 3. The actuating position occurs when a corresponding current prong of the electrical equipment is not sufficiently inserted within slot 26 so as to engage actuating arm 32 and disengage contact plate 34 from switch contacts 36 and 38. The non-actuating position occurs when the current prong of the electrical equipment disengages contact plate 34 from switch contacts 36 and 38. Spring 40 of alarm switch 30 normally biases contact plate 34 into the actuating position so that when the plug assembly of the electrical equipment is removed, alarm switch 30 will be actuated.

Referring again to FIG. 2, conductor cable 42 is positioned between male connector 12 and female connector 20. Cable 42 includes conductors 44–50 which inter-connect the respective power contacts and alarm switch 30, as shown. Alarm housing 52 is positioned on cable 42 between male connector 12 and female connector 20. Preferably, alarm housing 52 is positioned in close proximity to male connector 12 so that in the event alarm 54 is actuated, the alarm will be identified by a person nearest the power source in which male connector 12 is connected to. Alarm 54 is positioned within housing 52 and is actuated by alarm switch 30. Alarm 54 may provide a visual indication and/or an audible indication of removal of the electric equipment from connector 20 and may be any known type of indicator such as a light, an electro-acoustic transducer or the like. In this configuration, the conductors within cable 42 pass through or connect to components within alarm housing 52.

An example of suitable electrical connections for the power cable 10 of the present invention is shown in FIG. 2. As shown, conductor 44 is preferably the power conductor (i.e., the hot conductor) which is connected between current contact 18 of male connector 12, alarm contact 58 within alarm housing 52 and current slot 24 of female connector 20. Conductor 46 is the switched conductor which is connected between alarm contact 56 in alarm housing 52 and switch contact 36 of alarm switch 30. Conductor 48 is the ground conductor and is connected between grounding contact 14 and grounding slot 22. Conductor 50 is the neutral conductor which is connected between current contact 16 of male connector 12, current slot 26 of female connector 20 and switch contact 38 of alarm switch 30.

Figure 4:
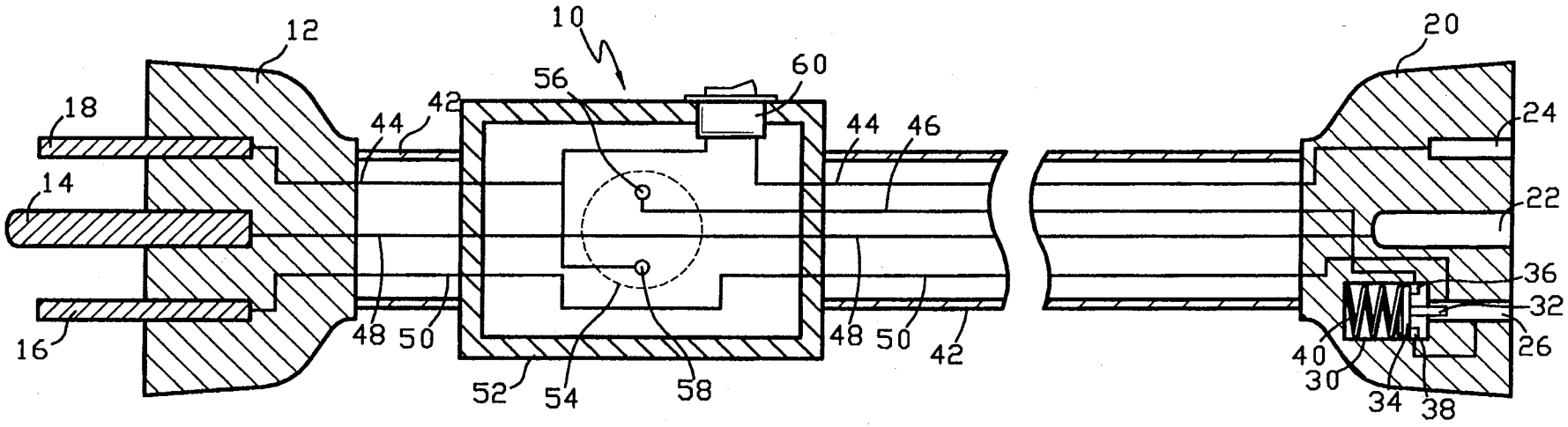
FIG. 4 is an alternative embodiment for the power cable of FIG. 2, illustrating a power switch connected to the power conductor of the power cable.

In an alternative embodiment shown in FIG. 4, power switch 60 is positioned within housing 52 and connected to power conductor 44 so that power to female connector 20 may be turned "on" and "off" without disconnecting alarm 54. In this configuration, if the electrical equipment is disconnected from female connector 20 when power switch 60 is in the off position, alarm 54 will actuate.

Figure 5:
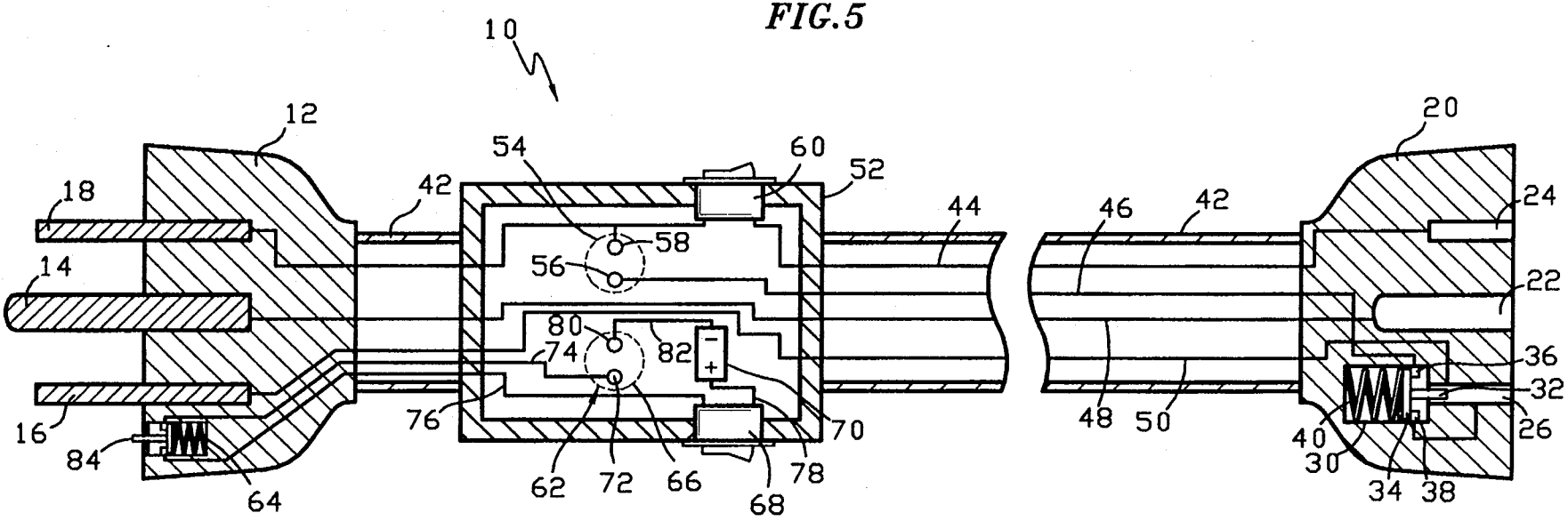
FIG. 5 is another alternative embodiment for the power cable of FIG. 2, illustrating a battery powered alarm system.

In another alternative embodiment, shown in FIG. 5, the power cable includes a battery powered alarm system 62 which includes alarm switch 64, alarm 66, d.c. power switch 68 and battery 70. Alarm 66 is positioned within housing 52 and is actuated by alarm switch 64. Alarm 66 may provide a visual indication and/or an audible indication of removal of connector 12 from the source of power and may be any known type of indicator such as a light, an electro-acoustic transducer or the like. As shown, alarm switch 64, which operates in a similar manner as alarm switch 30, is positioned within male connector 12 and is connected to alarm contact 72 of alarm 66 via conductor 74 and to d.c. power switch 68 via conductor 76. Preferably, the positive contact of battery 70 is connected to switch 68 via conductor 78 and the negative contact of battery 70 is connected to alarm contact 80 via conductor 82. Battery 70 may be any known type of d.c. power source. Preferably, battery 70 is a lithium type battery. Alternatively, the battery may be a rechargeable battery such as a nickel-cadmium type which is recharged when connector 12 is connected to a source of a.c. power. One skilled in the art would know the electrical connections for such a configuration.

In the configuration, shown in FIG. 5, for the battery powered alarm system 62, alarm 66 is actuated when switch 68 is in the "on" position and when connector 12 is removed from the source of power so that actuating arm 84 of alarm switch 64 is in the actuating position. Preferably, alarm switch 64 is configured and operates in a manner similar to alarm switch 30. Thus, the actuating and non-actuating positions of actuating arm 84 correspond to the actuating and non-actuating positions of actuating arm 32.

It will be understood that various modifications can be made to the embodiments of the present invention herein disclosed without departing from the spirit and scope thereof. For example, various lengths of the power cable are contemplated, as well as various types of circuit connections. Also, various modifications may be made in the configuration of the parts. Therefore, the above description should not be construed as limiting the invention but merely as exemplifications of preferred embodiments thereof. Those skilled in the art will envision other modifications within the scope and spirit of the present invention as defined by the claims appended hereto.

What is claimed is:

1. A power cable for supplying power to electrical equipment and detecting removal of the electrical equipment therefrom, which comprises:

an elongated cable having a first connector connected to one end thereof and a second connector connected to the other end of said cable, and having a plurality of conductors extending therethrough, said first connector having a plurality of contacts for connection to a source of electrical power and said second connector having a plurality of contacts for connection to the electrical equipment;

an alarm member integrally associated with said elongated cable; and means positioned within at least one of said connectors and operatively connected to said alarm member for actuating said alarm member upon disengagement of said connector from its associated connection.

2. The power cable according to claim 1, wherein said alarm member comprises a housing positioned along at least a portion of said elongated cable and an audible alarm connected to at least one of said plurality of conductors.

3. The power cable according to claim 1, wherein said first connector is a male connector and said second connector is a female connector.

4. The power cable according to claim 1, wherein said actuating means comprises a normally closed switch associated with at least one of said plurality of contacts of said second connector.

5. A power cable for supplying power to electrical equipment and detecting removal of the electrical equipment therefrom, which comprises:

an elongated cable having a first connector connected to one end thereof and a second connector connected to the other end of said cable, and having a plurality of conductors extending therethrough, said first connector having a plurality of contacts for connection to a source of electrical power and said second connector having a plurality of contacts for connection to the electrical equipment;

an alarm member integrally electrically associated with said elongated cable;

actuating means electrically connected to said alarm member for actuating said alarm member upon removal of at least one of said connectors from the associated one of said connections; and switch means electrically connected to said alarm member and connected to at least one of said plurality of conductors for selectively supplying the source of power to said second connector.

6. The power cable according to claim 5, wherein said alarm member comprises a housing positioned along at least a portion of said elongated cable and an audible alarm connected to at least one of said plurality of conductors.

7. The power cable according to claim 5, wherein said first connector is a male connector and said second connector is a female connector.

8. The power cable according to claim 5, wherein said actuating means comprises a normally closed switch associated with at least one of said plurality of contacts of said second connector.

9. A power cable for supplying power to electrical equipment, which comprises:

an elongated cable having a plurality of conductors extending therethrough and having first and second connectors connected to respective ends of said cable, said first and second connectors having a plurality of contacts for connection to a source of electrical power and to the electrical equipment, respectively;

alarm means integrally associated with said elongated cable and responsive to removal of said connectors from said connections, such that an alarm is generated upon disengagement of at least one of said connectors from the associated one of the connections; and actuating means positioned within at least one of said connectors and operatively connected to said alarm means for actuating said alarm means.

10. The power cable according to claim 9, wherein said alarm means is positioned within an alarm housing integrally associated with said elongated cable.

11. The power cable according to claim 10, wherein said alarm housing is positioned adjacent said first connector.

12. The power cable according to claim 10, wherein said alarm means comprises first and second audible alarm members, wherein said first alarm member is actuated when said first connector is disengaged from one connection, and said second alarm member is actuated when said second connector is disengaged from the other connection.

13. The power cable according to claim 12, wherein said actuating means comprises:

a first actuating switch integrally associated with said first connector and electrically connected to said first audible alarm member; and a second actuating switch integrally associated with said second connector and electrically connected to said second audible alarm member.

14. The power cable according to claim 12, wherein said first audible alarm member is powered by a d.c. power source and said second audible alarm member is powered by an a.c. power source.

15. The power cable according to claim 14, wherein said d.c. power source is a battery positioned within said alarm housing.

16. The power cable according to claim 12, wherein said first and second audible alarm members comprise electro-acoustic transducers.

17. The power cable according to claim 10 further comprising switch means positioned at least partially within said housing and operatively connected to at least one of said plurality of conductors for selectively supplying a source of power to said second connector.

18. The power cable according to claim 10 further comprising switch means positioned at least partially within said housing and operatively connected to at least one of said plurality of conductors for selectively supplying a source of power to said first connector.

19. The power cable according to claim 9, wherein said first connector is a male connector and said second connector is a female connector.

* * * * *